United States Patent [19]

Maddron

[11] 4,308,622

[45] Jan. 5, 1982

[54] THERMAL BODY SUIT

[76] Inventor: William F. Maddron, 1949 E. 28th, Eugene, Oreg. 97403

[21] Appl. No.: 191,668

[22] Filed: Sep. 29, 1980

[51] Int. Cl.[3] ..... A41D 13/02

[52] U.S. Cl. ..... 2/79; 2/125; 2/269

[58] Field of Search ..... 2/79, 227, 115, 125, 2/126, 93, 97, 96, 269

[56] References Cited

U.S. PATENT DOCUMENTS

| | | | |
|---|---|---|---|
| 2,153,838 | 4/1939 | Jay | 2/125 |
| 2,236,636 | 4/1941 | Young | 2/227 |
| 2,465,286 | 3/1949 | Silver | 2/126 X |
| 3,801,986 | 4/1974 | Puedon | 2/227 X |

FOREIGN PATENT DOCUMENTS

| | | | |
|---|---|---|---|
| 1803765 | 5/1970 | Fed. Rep. of Germany | 2/227 |
| 369081 | 12/1906 | France | 2/126 |
| 2345946 | 10/1977 | France | 2/126 |

*Primary Examiner*—H. Hampton Hunter
*Attorney, Agent, or Firm*—James D. Givnan, Jr.

[57] ABSTRACT

A one-piece body suit of insulated construction with enlarged upper sleeve segments which permit retraction of the wearer's arm to a position alongside the upper torso preparatory to hand extension out openings located along the length of the sleeve. Hand covers are integral with lower sleeve segments and include an elastomeric coating over individual finger sheaths. Each sleeve includes Velcro closure pieces serving to retain the vacated lower sleeve segment in a folded back position alongside the upper sleeve segment.

6 Claims, 3 Drawing Figures

THERMAL BODY SUIT

BACKGROUND OF THE INVENTION

The present invention pertains to a body suit for insulating the human body from abnormal temperatures.

Known clothing designs intended for use in abnormal temperatures are bulky to the extent they hinder the wearer from accomplishing certain manual tasks. Typically, the wearer must also wear mittens or gloves which must be removed prior to performing those manual tasks requiring some degree of dexterity. Repeated removal of gloves or mittens constitutes an inconvenience and, when removed, such are susceptible to misplacement.

Not known in the prior art is a unitary body garment suitable for both indoor and outdoor wear which fully covers the wearer's arms and hands yet permits rapid and convenient hand and forearm exposure for accomplishing various tasks.

SUMMARY OF THE PRESENT INVENTION

The present invention is embodied within a body suit particularly suited for indoor or outdoor use by those who frequently must have full and unemcumbered use of their hands. Such users may include outdoorsmen, photographers of wildlife, householders, etc.,.

The garment is of insulated construction having enlarged upper sleeves which, in conjunction with a sleeve opening, permits retraction of a user's arm toward the torso and subsequent extension of the hand and forearm outwardly through the opening. The opening is so located as to permit full exposure of the hand when extended therethrough to permit accomplishment of those manual tasks requiring full unemcumbered hand use. Directed toward this end is a deep cut upper sleeve which permits a wide range of upper arm movement relative the torso including arm retraction and subsequent outward extension of the hand through a medially located sleeve opening.

Provision is made for fastening the unused or vacated segment of the sleeve alongside the remaining upper sleeve segment by use of fastening means to prevent the vacated sleeve segment from interfering with the manual task at hand.

The suit is preferably formed from insulative fabric such as double faced cloth which incorporates insulation such as a polyester filler.

A combination glove and mitten hand cover is integral with each sleeve which provides individual coverings for the thumb and index finger to facilitate hand use. Such sleeve structure may be coated with an elastomer to prolong garment wear as well as to enhance frictional or gripping qualities of the hand cover.

Of the known prior art, U.S. Pat. No. 3,086,211 discloses a hand cover in the form of a mitten with individual thumb and index finger sheaths. U.S. Pat. No. 4,023,223 discloses the concept of a mitten integral with a garment sleeve and having a "patch" thereon enabling mitten retention back against the sleeve outer end on which a cooperating "patch" is affixed.

Important objects of the invention include the provision of a garment which is suitable for wear both in the home as well as outdoors and permits ready use of the wearer's hands and arms without opening or partial removal of the garment; the provision of an unencumbering garment for wear by those performing household tasks which enables the householder to reduce the temperature at which the house is kept to realize both energy and cost savings; the provision of a garment having enlarged or deep cut upper sleeves with a lower extremity of a shoulder seam being located proximate the wearer's waist; the provision of a garment having a sleeve a segment of which is foldable and with a fabric closure or the like serving to secure the vacated folded sleeve segment alongside an occupied sleeve segment; the provision of a garment which permits convenient extension and retraction of the wearer's hands from and to the sleeve interior; the provision of a garment having a hand cover with separate finger sheaths for the thumb and first finger having a flexible synthetic coating thereon to further facilitate the grasping of objects; the provision of a garment providing adequate heat retention qualities to the wearer yet not hindering him or her in accomplishing indoor or outdoor tasks or tasks requiring use of a bare hand or hands.

DETAILED DESCRIPTION OF THE PREFERRED EMBODIMENT

Figure 1:
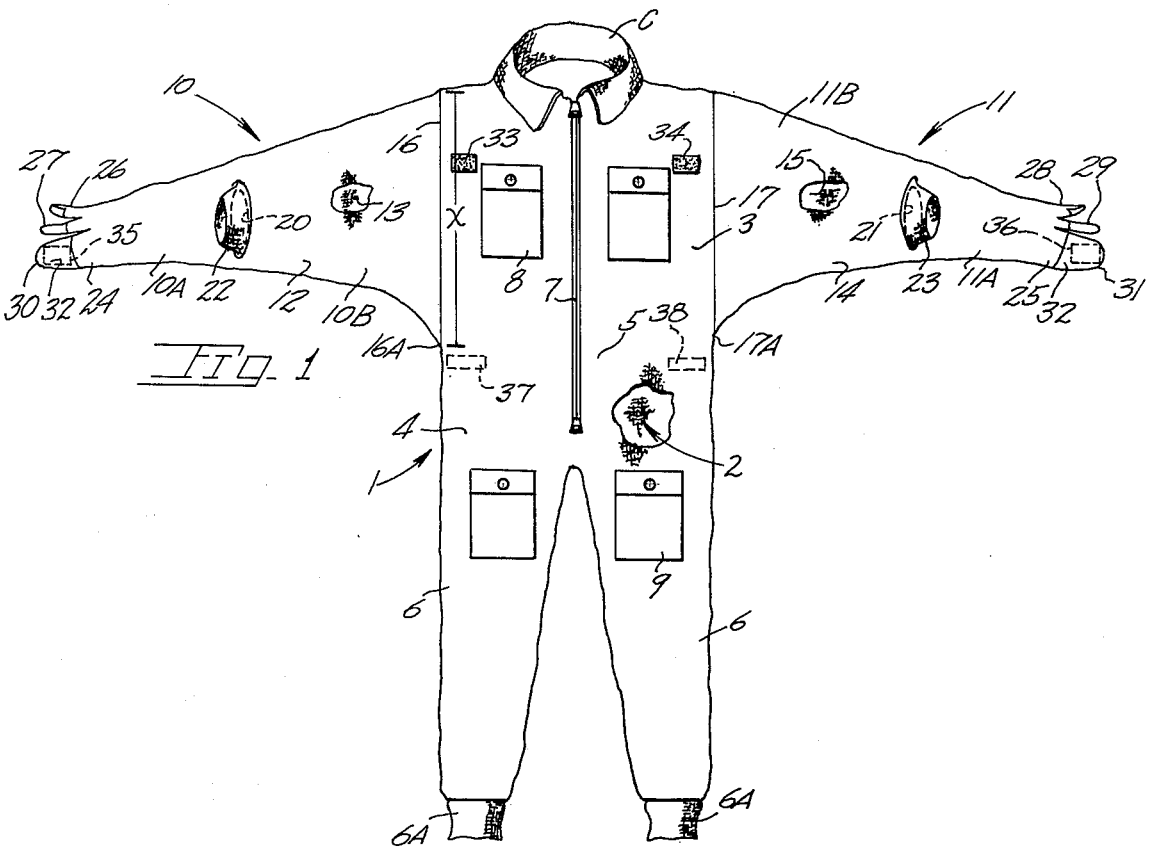
FIG. 1 is a front elevational view of the garment embodying the present invention.

With attention to the drawing, the reference numeral 1 generally indicates the front body panel of the present garment or suit. A back panel generally at 2 is substantially of corresponding size and shape. Stitching along the adjacent perimeters of the front and back panels provides a main body portion having upper and lower torso portions at 3 and 4, a waist portion at 5 and garment legs at 6 having ankle cuffs 6A. A closure shown as a zipper 7 extends substantially the length of the torso portions. Pockets are at 8 and 9. A collar is at C. The garment, to the foregoing extent described, may be considered substantially of conventional construction.

Right and left garment sleeves are indicated generally at 10 and 11 with upper and lower segments 10A-10B and 11A-11B. Each sleeve comprises, respectively, front and back panels as at 12–13 and 14–15. The sleeves may be termed as being deep cut for the reason that the sleeve upper segment from a sleeve midpoint to a continuous shoulder seam at 16 and 17 is greatly widened and have a vertical dimension at X to provide sufficient sleeve room to permit the wearer's upper arm therein to be retracted to the position shown in FIG. 2. In an adult man's garment, dimension X may be approximately seventeen inches and somewhat less in a like garment for an adult woman. The lowermost extremities of the shoulder seams are at 16A and 17A which are within waist portion 5 of the garment.

Figure 3:
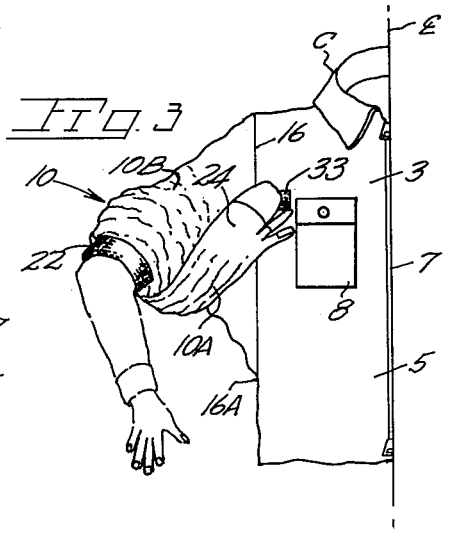
FIG. 3 is a typical view similar to FIG. 2 but with the wearer's forearm extended outwardly of the garment sleeve.

Along each sleeve front panel is an opening at 20 and 21 which has an elastic cuff thereabout as at 22 and 23 which permits outward extension of the hand and forearm as typically shown in FIG. 3. The cuffs, when not in use, tend to lie in a closed airtight position. The cuffs are of knitted elastic to stretch and cling to the forearm. In an adult man's suit the cuff centers are about sixteen inches from their respective shoulder seams.

Each sleeve terminates outwardly in a hand cover at 24 and 25 having individual thumb and first finger sheaths at 26–27 and 28–29. Enlarged sheaths at 30 and at 31 receive the remaining three fingers of each hand. A pliable synthetic exterior as at 32 is of a suitable elastomer and may be applied to the sheaths to enhance the gripping or frictional qualities of the hand covers. Such hand covers contribute to finger dexterity but provide beneficial heat conservation similar to a conventional mitten.

Figure 2:
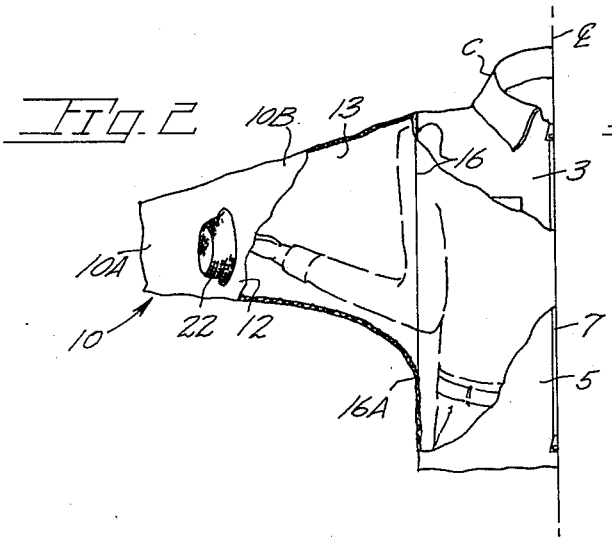
FIG. 2 is a fragmentary front elevational view of typical sleeve and front body panel portions of the garment with fragments broken away to show a wearer's arm positioned for subsequent extension out of a sleeve opening.

Sleeve retention means are shown as being of fabric closure material such as that sold under the registered trademark VELCRO. The "hook" components of such closure means are at 33–34 on the upper torso portion while cooperating "loop" components 35–35 are secured to the back side of the hand covers. With the forearm and hand extended from the unoccupied outer segment of each sleeve, at 10A in FIG. 3, may be folded under the occupied upper sleeve portion at 10B and attached to a "hook" component 33–34 to prevent sleeve interference with the task at hand. FIGS. 2 and 3 are typical of the unseen sleeve which would be a mirror image to the sleeve shown.

A pair of elastic segments at 37–38 at the garment waist serve to fit the garment to different girth sizes.

The present garment enables the performance of those manual tasks requiring an unencumbered hand(s) which may be conveniently returned to the sleeve interior. The suit is particularly suited for use in the home and enables the lowering of the home thermostat to realize the conservation of energy and a reduction in home heating costs. The suit may be of suitable insulative fabric, as above noted, with suit attractiveness supplemented by the wide array of colors and designs available to those in the garment manufacturing industry.

While I have shown but one embodiment of the invention it will be apparent to those skilled in the art that the invention may be embodied still otherwise without departing from the spirit and scope of the invention.

Having thus described the invention, what is desired to be secured under a Letters Patent is:

I claim:

1. A garment for wear in abnormal temperature environments, said garment comprising, a main body portion covering at least the upper torso of a wearer, and sleeves integral with said main body portion each sleeve including a hand cover, said sleeves each defining a hand receiving permanent opening located at a point along the sleeve length and through which a wearer's hand may be extended, each sleeve attached to the main body portion of the garment by a shoulder seam the lower extremity of which is at the waist portion of the garment, an elastic normally closed cuff disposed about each of the sleeve defined openings to prevent the loss of body heat therethrough.

2. The garment claimed in claim 1 including a sleeve to shoulder attaching seam having a vertical dimension X within a dimensional range of up to one and a half feet and of a greater length than the length of the upper arm of the wearer to permit momentary retraction of the wearer's upper arm against the torso preparatory to extension of a hand through a sleeve opening.

3. The garment claimed in claim 1 or 2 wherein each of said sleeves includes retention means cooperable with retention means on the main body portion for holding a lower segment of said sleeve in a folded back position alongside a sleeve upper segment when a wearer's hand is extended through said hand receiving opening.

4. The garment claimed in claim 3 wherein said retention means are cooperable fabric pieces secured to the main body portion and to the hand covers of the garment.

5. The garment claimed in claim 1 wherein said permanent opening is formed entirely in the front panel of a sleeve having front and rear panels.

6. A garment for wear in abnormal temperature environments, said garment comprising, a main body portion covering at least the upper torso of a wearer, and sleeves integral with said main body portion each sleeve including a hand cover, said sleeves each defining a hand receiving permanent opening located at a point along the sleeve length and through which a wearer's hand may be extended, each sleeve attached to the main body portion of the garment by a shoulder seam the lower extremity of which is at the waist portion of the garment, said permanent opening in each sleeve normally closed by sleeve structure when unoccupied to prevent loss of body heat therethrough.

* * * * *